US006821940B2

(12) United States Patent
Bullock et al.

(10) Patent No.: US 6,821,940 B2
(45) Date of Patent: Nov. 23, 2004

(54) WIPES FOR CLEANING FOODS, TOYS AND FOOD/CHILD CONTACT SURFACES

(75) Inventors: Steven S. Bullock, Loveland, OH (US); Nicholas A. Ahr, Cincinnati, OH (US); Jenna Heil, Cincinnati, OH (US); Brian J. Roselle, Fairfield, OH (US); Heather L. Moster, Oldenburg, IN (US); Dorothee Helene Davenet, Brussels (BE); Jean Wevers, Steenhuffel (BE)

(73) Assignee: The Procter & Gamble Company, Cincinnati, OH (US)

( * ) Notice: Subject to any disclaimer, the term of this patent is extended or adjusted under 35 U.S.C. 154(b) by 182 days.

(21) Appl. No.: 09/971,175

(22) Filed: Oct. 5, 2001

(65) Prior Publication Data

US 2002/0151452 A1 Oct. 17, 2002

Related U.S. Application Data

(60) Provisional application No. 60/249,723, filed on Nov. 17, 2000, and provisional application No. 60/290,860, filed on May 14, 2001.

(51) Int. Cl.[7] ..... C11D 17/04
(52) U.S. Cl. ..... 510/439
(58) Field of Search ..... 510/439

(56) References Cited

U.S. PATENT DOCUMENTS

| | | | | | |
|---|---|---|---|---|---|
| 2,374,209 | A | | 4/1945 | Kalmar | |
| 3,867,300 | A | | 2/1975 | Karabinos et al. | |
| 4,113,630 | A | * | 9/1978 | Hagner et al. | 252/8.6 |
| 4,118,525 | A | * | 10/1978 | Jones | 427/242 |
| 4,404,040 | A | | 9/1983 | Wang | |
| 4,442,125 | A | | 4/1984 | Thiele | |
| 4,592,892 | A | | 6/1986 | Ueno et al. | |
| 4,753,844 | A | * | 6/1988 | Jones | 428/288 |
| 4,772,501 | A | | 9/1988 | Johnson et al. | |
| 4,857,345 | A | | 8/1989 | Sardo | |
| 5,049,440 | A | | 9/1991 | Bornhoeft, III et al. | |
| 5,234,719 | A | | 8/1993 | Richter et al. | |
| 5,320,772 | A | | 6/1994 | Tricca | |
| 5,436,008 | A | | 7/1995 | Richter et al. | |
| 5,460,833 | A | | 10/1995 | Andrews et al. | |
| 5,498,295 | A | | 3/1996 | Murch et al. | |
| 5,500,048 | A | | 3/1996 | Murch et al. | |
| 5,500,143 | A | | 3/1996 | Murch et al. | |
| 5,503,764 | A | | 4/1996 | Murch et al. | |
| 5,749,924 | A | * | 5/1998 | Murch et al. | 8/137 |
| 5,849,678 | A | | 12/1998 | Murch et al. | |
| 5,908,707 | A | * | 6/1999 | Cabell et al. | 428/537.5 |
| 5,914,302 | A | | 6/1999 | Murch et al. | |
| 5,932,527 | A | | 8/1999 | Roselle et al. | |
| 5,972,857 | A | | 10/1999 | Roselle et al. | |
| 5,997,654 | A | | 12/1999 | Murch et al. | |
| 6,367,488 | B1 | | 4/2002 | Murch et al. | |
| 6,376,443 | B1 | | 4/2002 | Julemont | |
| 6,384,003 | B1 | | 5/2002 | Julemont | |
| 6,486,104 | B2 | * | 11/2002 | Patzer et al. | 510/111 |

FOREIGN PATENT DOCUMENTS

| | | |
|---|---|---|
| GB | 2 224 425 A | 5/1990 |
| WO | WO 97/01288 A1 | 1/1997 |
| WO | WO 97/01623 A1 | 1/1997 |
| WO | WO 97/15202 A1 | 5/1997 |
| WO | WO 00/61107 A1 | 10/2000 |
| WO | WO 01/83666 A2 | 11/2001 |

* cited by examiner

*Primary Examiner*—John Hardee
(74) *Attorney, Agent, or Firm*—Matthew P. Fitzpatrick; Ian S. Robinson; Edward J. Milbrada

(57) ABSTRACT

Premoistened wipes containing a substrate and a cleaning composition using toxicologically-acceptable ingredients for treating food such as produce, e.g., fruits and vegetables, edible animal proteins, toys baby high chairs and the like, are provided.

25 Claims, No Drawings

WIPES FOR CLEANING FOODS, TOYS AND FOOD/CHILD CONTACT SURFACES

CROSS-REFERENCE TO RELATED APPLICATIONS

This application claims the benefit of U.S. Provisional Application No. 60/249,723, filed Nov. 17, 2000, and U.S. Provisional Application No. 60/290,860, filed May 14, 2001.

TECHNICAL FIELD

The present invention relates to wipes, articles of manufacture and methods for cleaning and/or sanitizing/disinfecting, foods, food contact surfaces, toys and/or infant contact surfaces, especially for the purpose of making food safe for human consumption, and/or toys and/or infant contact surfaces making safe for children, safe for use by and around children.

BACKGROUND OF THE INVENTION

Fruits and vegetables, food contact surfaces, and sometimes other food products such as meats, are desirably washed prior to ingestion in order to remove soils and other unwanted residues, such as waxes and pesticides which may be undesirably clinging to the surfaces thereof. It is also desirable to reduce microorganisms on food and food contact surfaces, thus ensuring safety.

Similarly, toys and/or infant contact surfaces, such as, high chair trays and interiors of baby bottles, are also desirably washed prior to use by the child in order to remove soils and other unwanted residues which may be undesirably clinging to the surfaces thereof. This is especially true of toys that are left outside exposed to the elements, or toys dropped by a child while away from the home environment. Another problem is that of contact of a toy with multiple children either from infants visiting friends or friends coming to visit. A similar situation is faced by day care facilities, creches, play grounds, "theme" restaurants and the like where large numbers of children interact with the same toys and surfaces. The possible variety, number and volume of assorted bugs and other microbial organisms any given infant is exposed to is large enough for both parental and professional concern about the sanitary conditions of these facilities. The present solution typically involves the use of harsh chemicals, such as chlorine bleaches. While these work, they raise health and safety issues not only for the individual cleaning and sanitizing, but also for any infant who later contacts the surface. Furthermore, these are not easily transportable for use by a caregiver when they would need it the most, such as, when out shopping or traveling away from home.

Consequently, there remains a need for cleaning and sanitizing food, food contact surfaces, toys, and/or infant contact surfaces which are safe for the user as well as the infant, easy to use, convenient, readily transportable, while providing at least comparable, if not superior, cleaning and/or sanitizing to existing products.

BACKGROUND ART

U.S. Pat. Nos. 5,549,758, 5,705,461, 5,965,499, 5,500,143, 5,500,048, 5,498,295, 5,503,764, 5,997,654, 5,849,678, 5,749,924, 5,914,302, 5,879,470, 5,932,527, 5,972,857, 5,320,772, GB 2224425, WO 09701290A2, WO 09818352A1, WO 09850518A1, WO 09900026A1, WO 09900025A1, and WO 09856889A1.

SUMMARY OF THE INVENTION

In accordance with a first aspect of the present invention, a premoistened wipe is provided. The wipe comprises:

(a) a substrate; and
(b) a composition comprising:
  (i) optionally, a toxicologically-acceptable anionic surfactant;
  (ii) optionally, a toxicologically-acceptable chelant;
  (iii) optionally, a toxicologically-acceptable nonionic surfactant;
  (iv) optionally, a toxicologically-acceptable buffer;
  (v) optionally, a toxicologically-acceptable preservative;
  (vi) optionally, a toxicologically-acceptable suds suppressor;
  (vii) optionally, a toxicologically-acceptable perfume; and
  (viii) the balance comprising an aqueous carrier, the aqueous carrier comprising water and optionally, a low molecular weight, toxicologically-acceptable organic solvent;

wherein the composition contains at least one of (i) to (vii); is loaded onto the substrate at a loading factor of at least about 0.5 grams of composition per gram of dry substrate; and the substrate is releasably carrying the composition.

In accordance with second aspect of the present invention, an article of commerce is provided. The article of commerce comprises:

(1) container, said container housing;
(2) one or more premoistened wipes comprising:
  (a) substrate; and
  (b) cleaning composition comprising;
    (i) optionally, a toxicologically-acceptable anionic surfactant;
    (ii) optionally, a toxicologically-acceptable chelant;
    (iii) optionally, a toxicologically-acceptable nonionic surfactant;
    (iv) optionally, a toxicologically-acceptable buffer;
    (v) optionally, a toxicologically-acceptable preservative;
    (vi) optionally, a toxicologically-acceptable suds suppressor;
    (vii) optionally, a toxicologically-acceptable perfume; and
    (viii) the balance comprising an aqueous carrier, the aqueous carrier comprising water and optionally, a low molecular weight, toxicologically-acceptable organic solvent;

wherein the composition contains at least one of (i) to (vii); is loaded onto the substrate at a loading factor of at least about 0.5 grams of composition per gram of dry substrate; and the substrate is releasably carrying the composition; and
(3) a set of instructions comprising an instruction to wipe a surface with the premoistened wipe, wherein the surface is selected from the group consisting of food, toys, food contact surfaces and infant contact surfaces.

In accordance with a third aspect of the present invention, a method of promoting the sale of items is provided. The method comprises:

(I) contacting the items with a premoistened wipe comprising:
  (a) a substrate; and
  (b) a composition comprising:
    (i) optionally, a toxicologically-acceptable anionic surfactant;
    (ii) optionally, a toxicologically-acceptable chelant;
    (iii) optionally, a toxicologically-acceptable nonionic surfactant;

(iv) optionally, a toxicologically-acceptable buffer;

(v) optionally, a toxicologically-acceptable preservative;

(vi) optionally, a toxicologically-acceptable suds suppressor;

(vii) optionally, a toxicologically-acceptable perfume; and (viii) the balance comprising an aqueous carrier, the aqueous carrier comprising water and optionally, a low molecular weight, toxicologically-acceptable organic solvent;

wherein the composition contains at least one of (i) to (vii); is loaded onto the substrate at a loading factor of at least about 0.5 grams of composition per gram of dry substrate; and the substrate is releasably carrying the composition; and (II) providing informational indicia in association with the items to communicate to a consumer of the items that the items have been treated with the premoistened wipe.

Methods of using the premoistened wipes to clean the surface of an item, as defined hereinafter, are also an embodiment within the scope of the present invention.

In all of the above lists of components, if an ingredient can be classified in more than one place, it will be classified in the first place it can appear. In one embodiment of the present invention all ingredients of the composition are food grade, since they may be ingested.

All patents, articles, documents, and other materials cited herein are hereby incorporated by reference, unless otherwise indicated.

All percentages, ratios and proportions are by weight, and all temperatures are in degrees Celsius (° C.), unless otherwise specified. All measurements are in SI units unless otherwise specified.

DETAILED DESCRIPTION OF THE INVENTION

Definitions

The term "toy" is meant to literally be any non-living child's plaything. That is, the term "toy" includes within its meaning, balls, dolls, blocks, action figures, rattles and the like. Also included within the meaning of the term "toy", are items that are not specifically designed for use as a toy. This would include items that are viewed as a plaything by the child or items given to the child by a caregiver or parent for the child's amusement and/or distraction. For example, cooking utensils, such as wooden spoons, ladles, bowls, cups, storage containers, such as used baby wipe container, TUPPERWARE ® and the like and are included in this definition.

The phrase "second hand toy" means any toy, as defined above, which has been previously sold and is about to be resold by the original or subsequent purchaser. Alternatively, a third party could resell or be about to resell the toy, having acquired the toy by means other than purchasing. For example, the other means may include, donation or gift from the original purchaser. Alternatively, the third party recipient of the gift could be a child.

The phrase "infant contact surface" means any surface that an infant could either place in the mouth, place their mouth on (i.e. by gumming, chewing or licking a surface) or place something in their mouth which has been in contact with the surface (i.e. by eating food which has been dropped on to the surface, or placing a pacifier in the infant's mouth which has contacted the surface). Illustrative examples of the former include pacifiers (also known as "binkies" or "dummies"), baby bottle nipples or teats, rattles, the infant's hand, the infant's foot, articles of clothing, baby spoons, and the like. Illustrative examples of the latter include, the inside of a baby bottle, the hand or other exposed skin of a care giver, articles of clothing, a high chair-especially the tray on a high chair, or infant car seat, shopping carts, slides and the like in a park, kitchen counter tops, and the like.

The phrase "food contact surface" means any surface that food comes into contact with during the storage, preparation and/or serving of the food. Illustrative examples of food contact surfaces include, cutting boards, kitchen counter tops, flatware, pots, pans and other assorted cookware, aprons, tablecloths, refrigerators, tables, bars, sinks, and the like.

The term "item" or "items" means any food, including both foods for human and nonhuman consumption, food contact surface, as defined above, infant contact surface, as defined above, toy, as defined above and or second hand toy as defined above. The term "item" when used herein is, unless otherwise specifically indicated, is intended to mean both singular and plural, that is one item or more than one item. Similarly, the term "items" when used herein is, unless otherwise specifically indicated, is intended to mean both plural and singular, that is more than one item one item or one item. The terms "item" and "items" are used interchangeably herein.

The term "premoistened wipe" means a wipe or substrate in and on which a composition is distributed. The wipe contains sufficient composition to make it wet, damp or moistened. That is, the wipe has a loading factor of at least about 0.5 grams of composition per gram of dry substrate.

The term "releasably carrying" means that a composition is contained either in or on a substrate and is readily releasable from the substrate by applying some force to the substrate. For example, wringing the substrate, or wiping a surface, such as a toy or a piece of food, with the premoistened wipe.

The term "brand name" means a name, terms, phrases, color, or other indicia, which is associated with a consumer product or service. The "brand name" may be a famous one, such as TIDE®); MR. CLEAN®; or WINDOWS 95; or a no so famous one, such as JOLT COLA®; or ROTO-ROOTER®. "A "brand name" may or may not be trade marked.

As used herein, the term "comprising" means that the various components, ingredients, or steps can be conjointly employed in practicing the present invention. Accordingly, the term "comprising" encompasses the more restrictive terms "consisting essentially of" and "consisting of".

The term "infant" means a minor child. That is, a human being who is of a physical and/or mental age which requires some type of parental/caregiver supervision. Typically, this means children ranging from newborns to early, or possibly even late teens. However, adults who have a mental age equivalent to a child of this age range also fall within the definition of "infant". Similarly, adults who require constant monitoring and care, such as those suffering from dementia, and immune system deficiencies and the like also fall within the definition of "infant", because of the constant and intensive care needed. This means that the term "infant" includes in its definition human beings ranging in age from 0 to 100+.

Premoistened Wipe

The premoistened wipe of the present invention typically comprises a composition and a substrate. The methods of the present invention can be carried out by wiping the surface with the premoistened wipes of the present invention.

(A) Substrate

Referring to the components of the present invention in more detail, the premoistened wipe of the present invention includes a substrate comprising a woven or nonwoven web of natural fibers, synthetic fibers, or mixtures of natural and synthetic fibers. Suitable natural fibers include but are not limited to cellulosic fibers, such as wood pulp fibers, cotton, and rayon. Suitable synthetic fibers include fibers commonly used in textiles, including but not limited to polyester and polypropylene fibers.

Various forming methods can be used to form a suitable fibrous web for use in the present invention. For example, the web can be made by nonwoven dry forming techniques, such as air-laying, or alternatively by wet laying, such as on a papermaking machine. Other nonwoven manufacturing techniques, including but not limited to techniques such as melt blown, spunbonded, needle punched, and hydroentanglement methods, may also be used.

In one embodiment, the dry fibrous web can be an airlaid nonwoven web comprising a combination of natural fibers, staple length synthetic fibers and a latex binder. The dry fibrous web can be about 20–80 percent by weight wood pulp fibers, 10–60 percent by weight staple length polyester fibers, and about 10–25 percent by weight binder.

The substrate of the present invention may also comprise binders as known to the art. Suitable binders include latex binders; conform binders where the fibers comprise at least two polymers where one of the polymers has a melting point that is lower than the other; powdered polymeric binder where the polymeric powder has a lower melting point than the fibers comprising the substrate; and other binders as are known and used in the art.

The dry, fibrous web can have a basis weight of between about 40 and about 90 grams per square meter. However, the substrate dry, fibrous web can have a basis weight as low as 25 grams per square meter and up to as high as 200 grams per square meter. The density of the dry web can be measured after evaporating the liquid from the premoistened wipe, and the density can be less than about 0.15 grams per cubic centimeter. The density is the basis weight of the dry web divided by the thickness of the dry web, measured in consistent units, and the thickness of the dry web is measured using a circular load foot having an area of about 2 square inches and which provides a confining pressure of about 95 grams per square inch. In one embodiment, the dry web can have a basis weight of about 64 grams per square meter, a thickness of about 0.06 cm, and a density of about 0.11 grams per cubic centimeter.

In one embodiment, the dry fibrous web can comprise at least 50 percent by weight wood pulp fibers, and more preferably at least about 70 percent by weight wood pulp fibers. One particular airlaid nonwoven web which is suitable for use in the present invention comprises about 73.5 percent by weight cellulosic fibers (Southern softwood Kraft having an average fiber length of about 2.6 mm); about 10.5 percent by weight polyester fibers having a denier of about 1.35 gram/9000 meter of fiber length and a staple length of about 0.85 inch; and about 16 percent by weight of a binder composition comprising a styrene butadiene copolymer. The binder composition can be made using a latex adhesive commercially available as Rovene 5550 (49 percent solids styrene butadiene) available from Mallard Creek Polymers of Charlotte, N.C.

One suitable airlaid nonwoven web for use in the present invention is the airlaid nonwoven web employed in PAMPERS® BABY FRESH brand baby wipes marketed by The Procter & Gamble Co. of Cincinnati, Ohio.

Other suitable nonwoven webs include, but are not limited to, spun lace nonwoven web containing 100% polyester available from Green Bay Nonwoven; and carded nonwoven web containing 70/30 mixture of polypropylene/rayon available from PGI.

The pre-moistened wipe is made by wetting the dry substrate with at least 0.5 grams of composition per gram of dry fibrous web. Preferably, the dry substrate is wetted with at least about 1.0 grams, and more preferably at least about 1.5 grams of composition per gram of the dry substrate. Preferably, the dry substrate is wetted with at most about 5.0 grams, more preferably at most about 4.0 grams, even more preferably at most about 3.5 grams of composition per gram of the dry substrate. A "loading factor" of 0.5 means that the dry substrate is wetted with 0.5 grams of composition per gram of dry substrate.

The manufacture of the following patents are incorporated herein by reference for their disclosure related to webs: U.S. Pat. No. 3,862,472 issued Jan. 28, 1975; U.S. Pat. No. 3,982,302 issued Sep. 28, 1976; U.S. Pat. No. 4,004,323 issued Jan. 25, 1977; U.S. Pat. No. 4,057,669 issued Nov. 8, 1977; U.S. Pat. No. 4,097,965 issued Jul. 4, 1978; U.S. Pat. No. 4,176,427 issued Dec. 4, 1979; U.S. Pat. No. 4,130,915 issued Dec. 26, 1978; U.S. Pat. No. 4,135,024 issued Jan. 16, 1979; U.S. Pat. No. 4,189,896 issued Feb. 26, 1980; U.S. Pat. No. 4,207,367 issued Jun. 10, 1980; U.S. Pat. No. 4,296,161 issued Oct. 20, 1981; U.S. Pat. No. 4,309,469 issued Jan. 25, 1982; U.S. Pat. No. 4,682,942 issued Jul. 28, 1987; and U.S. Pat. Nos. 4,637,859; 5,223,096; 5,240,562; 5,556,509; and 5,580,423.

In one alternative embodiment, the substrate can comprise a hydroentangled web having a basis weight of about 62 grams per square meter and comprising about 50 percent by weight rayon fibers and about 50 percent by weight polyester fibers, polypropylene fibers, or a combination thereof. In another alternative embodiment, the substrate can comprise a laminate of two outer hydroentangled webs, such as nonwoven webs of polyester fibers having a basis weight of about 30 grams per square meter, joined to an inner constraining layer, which can be in the form of net-like scrim material which contracts upon heating to provide surface texture in the outer layers.

In one embodiment of the present invention the surface of substrate is essentially flat. In another embodiment of the present invention the surface of the substrate may optionally contain raised and/or lowered portions. These can be in the form of logos, indica, trademarks, geometric patterns, images of the surfaces that the wipes are intended to clean (i.e. fruit, toys, infant contact surfaces etc.,). They may be randomly arranged on the surface of the substrate or be in a repetitive pattern of some form. They may be on one or both surfaces of the substrates. In one embodiment the substrate contains a repetitive pattern or alternating raised and lowered portions of the substrate. This variation in or on the surface of the substrate may be included to convey to the consumer information on the wipes intended use, which brand or type of wipe they are using or even aid in cleaning of the surface that the wipe is applied to. In one embodiment the surface of the substrate that is in contact with the consumer is smooth, while the opposing surface that contacts the item cleaned is rough or irregular in some fashion. It is believed, while not wishing to be limited by theory, that the variations in or on the surface providing mechanical effort to the surface in addition to the wiping action.

It is also within the scope of the present invention that the term substrate includes laminates of two or more substrates. Commercially available laminates, or purpose built ones would also be within the scope of the present invention.

In one embodiment of the present invention the substrate is edible. That is, the substrate could be swallowed and at least partially, if not totally, digested by a person. The digestion would be in no way harmful to the individual and could provide some additional fiber and possibly some nutrition. Examples of such edible substrates would be made of webs produced from starch, corn, rice and possibly even cellulose.

In one embodiment of the present invention the substrate is flushable. That is, it may be disposed of by flushing it down a toilet, commode or the like. The substrate would not block the toilet or be a problem for a septic system.

In another embodiment of the present invention the substrate is biodegradable. For example the substrate could be made from a biodegradable material such as a polyesteramide.

(B) Cleaning Composition

The following toxicologically-acceptable ingredients are used in the preparation of the preferred compositions herein. By "toxicologically-acceptable" is meant that any residues from the ingredients of the compositions which may remain on the items, foods, food contact surfaces, toys, infant contact surfaces, etc., cleansed therewith are safe for ingestion by humans and/or lower animals.

The ingredients in the compositions are preferably "food grade". The ingredients are preferably also selected to have minimal odor, both initially and after storage. The lack of objectionable odor is especially important in compositions for use on food, toys or infant/food contact surfaces.

Preferred compositions for use herein contain only materials that are food grade or GRAS, including, of course, direct food additives affirmed as GRAS, to protect against possible misuse by the consumer. Traditionally, most suggestions for cleaning of fruits and/or vegetables have contemplated a commercial scale where there is typically more control over the conditions, especially the amount and thoroughness of rinsing. The present invention includes use by individual consumers without rinsing, so that it is essential that extra safety be built into the product. Failure to rinse thoroughly after cleaning is less of a concern if all of the ingredients are GRAS and/or food grade.

The use and selection of cleaning ingredients for the purpose of washing fruits and vegetables is described by the United States Code of Federal Regulations, Title 21, Section 173.315: "Ingredients for use in washing or lye peeling of fruits and vegetables". These regulations restrict the ingredients that may be used for direct contact with food to those described as "generally recognized as safe" (GRAS), and a few other selected ingredients. These sections also provide certain limitations on the amount of material that can be used in a given context. However, there are no regulations, or suggestions, for methods of making food safe for consumption using aqueous compositions that do not need to be removed.

Other suitable ingredients for use in the compositions of the present invention can be found in the following patents and patent applications, all of which are incorporated herein by reference: U.S. Pat. Nos. 5,549,758, 5,705,461, 5,965,499, 5,500,143, 5,500,048, 5,498,295, 5,503,764, 5,997,654, 5,849,678, 5,749,924, 5,914,302, 5,879,470, 5,932,527, 5,972,857, WO 09701290A2, WO 09818352A1, WO 09850518A1, WO 09900026A1, WO 09900025A1, and WO 09856889A1.

Composition pH

The pH of the composition of the present invention can vary. The composition may be alkaline, i.e. have a pH from about 9.5 to 13.0; be acidic, i.e. have a pH from about 2 to about 6; or even have a "neutral" pH, i.e. have a pH from about 6 to about 9.5. The choice of pH depends upon the many factors. These include, but are not limited to, substrate choice, components of the composition, item to be cleaned, etc.

In any event whichever pH range is selected it is preferred that all components of the premoistened wipe, be stable in that pH range. That means that all the components present in the composition, and the substrate are stable in that pH range. For example in a premoistened wipe which has a pH range of from about 9.5 to about 13.0, more preferably from about 10.0 to about 13.0, even more preferably from about 10.5 to about 13.0, will comprise a substrate and components of the composition which are all base stable. Similarly, in a premoistened wipe that has a pH range of about 2.0 to about 6.0, more preferably from about 2.5 to about 5.0, even more preferably from about 2.5 to about 4.0, will comprise a substrate and components of the composition that are all acid stable.

(i) Anionic Surfactant

Anionic surfactants can be employed, e.g., preferably those approved for use on foods, such as allowed in the United States by the United States Code of Federal Regulations (CFR), Title 21. Specific mention is made of salts of dodecylbenzene sulfonate, typically at levels up to 0.2% in use, and sodium lauryl sulfate. Also described in the CFR are phosphate esters of ethylene and/or ethylene/propylene oxide adducts of aliphatic alcohols, dioctyl sulfosuccinate, 2-ethylhexyl sulfate, and mono and di-methyl naphthalene sulfonates.

The anionic surfactant is preferably selected from materials known in the art, such as $C_{6-18}$ alkyl sulfates and/or sulfonates; $C_{6-15}$ alkylbenzene sulfonates; $C_{6-18}$ alkyl ether sulfates; $C_{8-18}$ fatty acids and salts thereof, di-$C_{6-10}$ alkyl sulfosuccinates, and the like. Mixtures of these anionic materials are also within the scope of the present invention. The alkyl sulfates are preferred for antimicrobial effectiveness and palatability, especially as the sodium salts. A highly preferred anionic surfactant is sodium lauryl sulfate. Sodium and potassium $C_{8-14}$ soaps (fatty acid salts) are not preferred as stand alone surfactants in acid conditions. However, they may still be present especially in neutral or basic conditions, with suitable ones including oleic acid and salts thereof. Mixtures of such alkyl sulfates and sulfonates are also preferred.

Anionic surfactant, when present, is typically employed in compositions at levels of from about 0.001% to about 5%, preferably from about 0.002% to about 2%, and more preferably from about 0.003% to about 1%, by weight of the composition.

Optional Acid Surfactants and Amphoteric/Zwitterionic Surfactants

The compositions herein can contain acid surfactants like alklybenzenesulfonic acid, amphoteric surfactants and/or zwitterionic surfactants, and low levels of protonated fatty surfactants like lauric acid.

The detergent surfactant also is used for reduction of the surface tension and controlling viscosity. It is highly desirable that the dilute treatment compositions have a low viscosity, typically less than about 50, preferably less than about 10, and more preferably less than about 5. The low viscosity improves the completeness of the treatment by promoting spreading over the surface of the item, especially where there are layers, rugosities, etc. The low viscosity also improves drainage, thus providing at least some soil removal. Low viscosity also improves the speed of drying, if that is desired. Thus, the detergent surfactant provides highly important advantages in terms of treatment.

In combination with an organic acid, such as citric acid, the detergent surfactant improves antimicrobial action. The presence of the surfactant, and especially the alkyl sulfate, provides improved kill and/or rate of kill, especially for short times and/or lower pH.

Suitable amphoteric and/or zwitterionic surfactants would include those that are especially mild and suitable for use in child care products, such as baby washes and children's shampoo. Examples include, cocoa amidopropyl betaine and sodium lauro amphoacetate. Mixtures of amphoteric and/or zwitterionic surfactants are also within the scope of the present invention.

If the wipe is specifically designed for use on food it is important that the detergent surfactant not affect palatability. Accordingly, the level should be low.

If used in the present compositions, acid surfactant and/or acid-sensitive amphoteric surfactant may be employed at levels of from about 0.0002% to about 2%, preferably from about 0.001% to about 0.7%, and more preferably from about 0.002% to about 0.4%, by weight of the dilute aqueous treatment composition.

(ii) Chelant

The preferred chelant herein are polyphosphate salts or organic polycarboxylic salts, e.g., sodium and/or potassium citrate, and/or sodium and/or potassium ethylenediaminetetraacetate, which are standard items of commerce and are GRAS. Other organic polycarboxylic acids, especially those that are GRAS, such as citric, tartaric, malic, etc. acids, can also be used. Complex phosphates can also be used, but are generally avoided due to regulatory considerations where phosphate levels are specifically forbidden or highly restricted. Typically, if used, the chelant is present at a level of from about 0.0005% to about 3%, preferably from about 0.001% to about 0.5%, and more preferably from about 0.003% to about 0.2%, by weight of the composition. Chelant can maintain the efficacy of the formulas in the presence of hardness.

(iii) Nonionic Surfactant

Nonionic surfactants, when used, are preferably selected from materials known in the art, such as alkylene oxide (ethylene oxide and/or propylene oxide) adducts of $C_{10-18}$ aliphatic alcohols or acids, polysorbates, $C_{10-18}$ aliphatic alcohol adducts of glucose (alkyl polyglucosides). The specific nonionic surfactant selected ideally has a hydrophilic-lipophilic balance (HLB) greater than about 8, and a cloud point above about 35° C. in the composition. Mixtures of nonionic surfactants having effective HLB in this range are also possible. The United States Code of Federal Regulations (CFR) specifically describes an ethylene oxide/propylene oxide adduct of $C_{12-18}$ aliphatic alcohol of molecular weight of about 800. Such a material is available as PLURAFAC RA-20 (BASF).

In compositions containing soap, the alkoxylated alcohol functions mainly as a dispersant for any soap curd, which may form during the cleansing operation. Further, it is recognized that the selection of non-nitrogen containing nonionics can minimize the possibility of microbial growth in the dilute surfactant compositions.

If used in the present compositions, nonionic surfactant is typically present at levels from about 0.0002% to about 2%, preferably from about 0.001% to about 0.7%, and more preferably from about 0.002% to about 0.4%, by weight of the composition.

(iv) Buffer

Toxicologically-acceptable buffers are used in the compositions herein to maintain product pH in the desired range. For ease of formulatability, it is often desirable that such buffers be in their potassium salt form, especially in liquid concentrates that utilize neutralized fatty acid surfactants. Sodium salts are acceptable, and even preferred, in conjunction with alkyl sulfate/sulfonate surfactants. Potassium and/or sodium carbonate, potassium and/or sodium bicarbonate, potassium and/or sodium hydroxide (hydrate), potassium and/or sodium citrate and/or potassium and/or sodium orthophosphate are convenient and preferred pH buffers. Calcium and/or magnesium hydroxides can also be used to create a basic pH, especially if the composition does not contain calcium ion sequestrant. Sodium and potassium hydroxides can be used as part of buffer systems. The levels and identities of the ingredients are adjusted to provide dilute products having the desired viscosities as set forth herein, e.g., less than about 50, preferably less than about 10, more preferably less than about 5 centipoise under shear of $\geqq$~1000 $sec^{-1}$.

The pH is preferably not greater than about 13, and especially does not contain large amounts of buffer at higher pHs for consumer safety, especially when the compositions are not fully removed from items. Reserve alkalinity should be from about 0.01 to about 10, preferably from about 0.05 to about 7, and more preferably from about 0.1 to about 4. Similarly, the pH is not lower than about 2.0 and especially does not contain large amounts of buffer at lower pHs for consumer safety, especially when the compositions are not fully removed from items.

In the compositions, the level of buffer, when present, is typically from about 0.0005% to about 10%, preferably from about 0.0015% to about 5%, and more preferably from about 0.0025% to about 1.5%, by weight of the composition.

(v) Preservative

Formulating the present compositions at high pH reduces the tendency for biological growth of contaminants, such as bacteria, fungi, or molds. Similarly, in compositions with acidic or neutral pH biological growth of contaminants, such as bacteria, fungi, or molds may also be an issue. However, preservatives can help insure the lack of biological growth through contamination in making or in use. Preservatives may be present in composition of any pH, i.e., acidic, neutral or basic compositions may all optionally contain a preservative. One illustrative preservative is Suttocide A, available from Sutton Laboratories.

Preservatives, when used, are typically present in the compositions at levels from about 0.001% to about 5%, preferably from about 0.002% to about 2%, and more preferably from about 0.003% to about 1%, by weight of the composition.

(vi) Suds Suppressor

At low levels, suds suppressors or anti-foamers can be used, especially in the case where a certain surfactant level is desired for wetting and/or efficacy, but the degree of foam generated in the washing of produce is desired to be kept low. The amount of suds suppresser can be tailored in conjunction with the type and level of surfactant used. Suitable silicone suds suppressors are available from suppliers such as, DC-4270 and DC2-4242 available from Dow Corning.

Suds suppressor, when used is typically present in the compositions at levels from about 0.001% to about 5%, preferably from about 0.002% to about 2%, and more preferably from about 0.003% to about 1%, by weight of the composition.

(vii) Perfume

Perfumes are optionally incorporated in the present compositions to impart an aesthetically satisfying odor to the composition. A variety of perfume materials can be utilized, especially those imparting odor characters such as citrus, pine, and "outdoor" fresh. Alternatively, a perfume may be incorporated in order to mask any objectionable ingredient odor. For example, below pH about 9.7, the compositions containing fatty acids, can exhibit some objectionable fatty acid odor, and even at pH's above 11, some odor can persist.

As noted most cleaning products contain some perfume to provide an olfactory aesthetic benefit and to cover any "chemical" odor that the product may have. The main function of a small fraction of the highly volatile, low boiling (having low boiling points), perfume components in these perfumes is to improve the fragrance odor of the product itself, rather than impacting on the subsequent odor of the surface being cleaned. However, some of the less volatile, high boiling perfume ingredients can provide a fresh and clean impression to the surfaces, and it is sometimes desirable that these ingredients be deposited and present on the dry surface. For the purposes of the present invention, the term "perfume" is taken to include those ingredients that impart an aesthetic olfactory benefit. Such ingredients can include traditional perfumes, natural extracts, essences, and flavorings. The perfumes are preferably those that are more water-soluble and/or volatile to minimize spotting and filming. If a perfume is present, it is preferred that the perfume be "food grade" or GRAS (defined hereinbefore) at the levels employed in order to be consistent with the essential character of the invention. Especially preferred for this use are oils derived from citrus fruit, e.g., oranges, lemons, limes, grapefruits, tangerines, tangelos, etc. which contain relatively large amounts of terpenes. One such suitable perfume is Waterlily. Of particular usefulness are those perfumes that impart a citrus or lime character to the composition. Some of the perfumes useful herein are described in more detail in U.S. Pat. No. 5,108,660, Michael, issued Apr. 28, 1992, at col. 8 lines 48 to 68, and col. 9 lines 1 to 68, and col. 10 lines 1 to 24, said paten said specific portion, being incorporated by reference.

Flavoring agents can optionally be added as additional ingredients to further enhance the aesthetics of the product or desirability of the toy to a child. Although normal usage of the present compositions on food surfaces would typically include a rinse step, there can be instances where rinsing is not available or even desired (e.g. where the water might be contaminated). In this case, a flavoring agent and/or sweetening agent can be incorporated to smooth any tart taste that might accompany any residual acid present in the composition and deposited on food surfaces. This could equally apply, to certain types of toys or infant contact surfaces, such as, pacifiers, teething rings, etc.

Flavoring agents include those typically used in food and include extracts and artificial flavors. Vanilla, fruit flavors, and the like are preferred. Suitable sweetening agents for use in the compositions include natural and artificial sweeteners such as sucrose, fructose, dextrose, invert sugar, sorbitol, aspartame, saccharin, high fructose corn syrup.

Sometimes, coloring agents may optionally be added to further enhance or differentiate the aesthetic appearance of the product. Food grade coloring agents are the preferred materials. In general, when colors are used, the preferred colors are those colors that are seen in food like fruits and vegetables, or those, which a caregiver would associate as being child friendly or safe. Red, as in apples, green, as in limes or broccoli, orange as in oranges, yellow as in lemons are desired colors.

Perfume, when used, is typically present in the compositions at levels from about 0.001% to about 5%, preferably from about 0.002% to about 2%, and more preferably from about 0.003% to about 1%, by weight of the composition.

(viii) Aqueous Carrier

The major proportion, e.g., more than about two thirds, (typically, approximately 80%–99.7%, by weight) of the compositions herein comprises water as the solubilizing carrier for the ingredients and optionally, a toxicologically-acceptable organic solvent. Suitable optional toxicologically-acceptable organic solvent include, but are not limited to, $C_2$–$C_6$ alcohols, $C_2$–$C_6$ diols, $C_3$–$C_6$ triols, and mixtures thereof One suitable combination of water and optional toxicologically-acceptable organic solvent is water and ethanol. The level of optional toxicologically-acceptable organic solvent when present in the composition preferably should not exceed 10% in the composition to avoid an alcoholic odor. However, higher levels may be used in situations where the alcoholic odor is not an issue, or the optional toxicologically-acceptable organic solvent does not have an alcoholic odor associated with its use. Another preferred optional toxicologically-acceptable organic solvent is glycerol.

Mixtures of optional toxicologically-acceptable organic solvents are within the scope of the present invention.

Optional toxicologically-acceptable organic solvent, when used, is typically present in the compositions at levels from about 0.001% to about 10%, preferably from about 0.002% to about 8%, and more preferably from about 0.003% to about 6%, by weight of the composition.

Other Optional Ingredients (ix)–(xii)

(ix) Electrolytes

The compositions of the present invention may optionally include an electrolyte. Suitable electrolytes include, but are not limited to, alkali, alkaline earth salts, and other water soluble salts which are suitable for use in the present invention. That is, any electrolyte is a GRAS ingredient or is recognized as a food safe ingredient. Examples include, but are not limited to: calcium disodium ethylenediaminetetraacetate (EDTA), disodium EDTA, potassium nitrate, sodium nitrate, sodium nitrite, calcium chloride, calcium silicate, magnesium silicate, ammonium bicarbonate, ammonium carbonate, ammonium chloride, and mixtures thereof.

It will be recognized that the above electrolyte salts should preferably be used in amounts that are non-toxic and which do not cause unacceptable taste and/or feel in the mouth when the salts are not removed.

Electrolyte, when used, is typically present in the compositions at levels from about 0.001% to about 5%, preferably from about 0.002% to about 2%, and more preferably from about 0.003% to about 1%, by weight of the composition.

(x) Polyethylene Glycol

The compositions of the present invention may optionally contain polyethylene glycol. The water-soluble polyethylene glycol polymer, or PEG, is the known article of commerce and is available under a variety of trade names, of which CARBOWAX (Union Carbide Corporation) is exemplary. PEG's in the average molecular weight range of from about 200 to about 20,000 can be used herein, and PEG as CARBOWAX in the average molecular weight range of at least about 200, typically 300 to about 9500, is convenient and preferred. The amounts of PEG used can vary with the molecular weight of the PEG, the amount of surfactant used in the composition, the desired viscosity of the composition, and like factors within the discretion of the formulator.

The compositions herein which contain the polyethylene glycol are characterized not only by their excellent cleaning performance and sudsing/rinsability properties, but also by their improved "feel". The improved feel of the compositions, which come into contact with the users' hands, is a qualitative tactile impression. However, this improved, "non-slippery", "non-soapy" improvement in skin feel can be demonstrated by rubbing Test (PEG-containing) and Control (no PEG) compositions on the hands or inner forearms of volunteer graders. Even in such rudimentary tests, the graders can readily distinguish the improved tactile impression of the compositions.

Polyethylene Glycol, when used, is typically present in the compositions from about 0.001% to about 5%, preferably from about 0.002% to about 2%, and more preferably from about 0.003% to about 1%, by weight of the composition.

(xi) Antioxidants

The use of surfactants, and especially soaps, may be complicated by development of off-odors and/or yellowing of the compositions in which they appear. These undesirable properties are believed to be caused by complex side reactions initiated by the reaction of oxygen, with, for example, any polyunsaturated components of any fatty acid present. These results can be avoided, or minimized, by avoiding contact with air, or by controlling the quality of the fatty acid stock so that the amount and type of polyunsaturates are minimized, or by minimizing oxygen sensitive components, and/or by the addition of chelants and/or antioxidants.

It has been found, that the addition of tocopherols (e.g., Vitamin E, or tocopherol acetates) in alkaline formulations is advantageous, as they do not degrade, nor do they impart a strong color. They inhibit the development of off-odors for extended periods of time so that the need for masking scents is minimized, or eliminated, particularly for oleic acid stocks of high quality, as described above. The use of butylated phenols, such as BHT and BHA is also useful, but their effectiveness appears more limited and they can impart stronger colors to the compositions. Other food grade antioxidants such as Vitamin C, sorbates, and sulfites, are desirable to prevent deterioration of the compositions by the action of oxygen, but care must be taken since vitamin C can suffer color degradation and sulfites can cause odor problems. Sulfites also have been the target of potential health concerns.

Antioxidants when used, is typically present in the compositions at levels from about 0.001% to about 5%, preferably from about 0.002% to about 2%, and more preferably from about 0.003% to about 1%, by weight of the composition.

(xii) Hydrotrope

An optional ingredient, which is sometimes present in the composition, is a hydrotrope, which serves to stabilize the compositions by aiding in the solubilization of their components. Typically, the hydrotrope serves to solubilize the otherwise insoluble materials. The hydrotrope is typically selected from the group consisting of alkali metal, ammonium, and triethanolammonium isopropylbenzene sulfonates, xylene sulfonates, toluene sulfonates, cumene sulfonates, benzene sulfonates, and mixtures thereof. Specific hydrotropes found to be useful in the present compositions are sodium cumene sulfonate and potassium toluene sulfonate, with sodium cumene sulfonate being most preferred. When present, hydrotropes are incorporated in the compositions at a level from about 0% to about 5%, preferably from about 1% to about 3%, more preferably from about 1.2% to about 2% by weight of the composition.

(C) Article of Manufacture

The present article of manufacture encompasses premoistened wipe products as described hereinbefore that can be packaged in a container with a set of instructions for the consumer. The article of manufacture of the present invention typically comprises (a) a container, (b) one or more premoistened wipes, and (c) a set of instructions comprising an instruction to wipe a surface with the premoistened wipe, wherein the surface is selected from the group consisting of food, toys, food contact surfaces and infant contact surfaces.

Containers useful in the present article include but are not limited, for example, PET tubs, flow wrap pouches, precut sachets for individually packed wipe, and other packaging known in the art for premoistened wipe products. Typically, premoistened of the present invention are stored in the containers to reduce evaporation of the compositions loaded onto the premoistened wipe. The container can also facilitate individual wipe removal.

The article of manufacture of the present invention further comprises a set of instructions in association with the container. As used herein, the phrase "in association with" means the instructions are either directly printed on the container itself or presented in a different manner including, but not limited to, a brochure, print advertisement, electronic advertisement, and/or verbal communication, so as to communicate the set of instructions to a consumer of the article of manufacture.

The set of instructions can comprise, for example, the instruction to squeeze a premoistened wipe of the present invention to release the composition onto a surface to be treated. The set of instructions can further comprise the instruction to evenly spread the composition across the surface with the substrate of the premoistened wipe. The set of instructions may optionally further comprise the instruction to allow the composition to remain on the treated surface, without rinsing or otherwise removing the composition from the treated surface. Alternatively, the instructions may instruct the consumer not to squeeze the premoistened wipe of the present invention and instead to wipe the surface with the premoistened wipe either with or without rinsing, The instructions may include directions to use one wipe only or instructions to use multiple wipes, say two, or three or possibly even more.

The present article of manufacture further comprises a set of instructions comprising an instruction to contact inanimate surfaces, namely infant contact surfaces, toys, and/or food contact surfaces, with the premoistened wipe of present invention. The set of instructions can comprise instruction(s) to carry out the methods described hereinafter. The set of instructions is typically in association with the container of the present article.

In a further embodiment of the present invention a second premoistened wipe, which comprises a substrate and water and optionally, a low molecular weight, toxicologically-acceptable organic solvent or mixtures thereof which is in association with the article of manufacture. This second premoistened wipe is applied to the surface on which the premoistened wipe containing the composition has been applied, to remove the composition and anything that has been removed from the surface by application of the first wipe thereto. This second wipe provides the equivalent to a water rinse with the convenience of a wipe.

In preparing the premoistened wipes of the present invention the composition need to be placed on and/or in the substrate. Techniques for combining the wipe substrates with the composition of the present invention are well known in the art. Examples of common methods of combining the composition with the substrate may involve coating, immersing, dipping, or spraying, the substrate with the composition of the present invention. The composition of the present invention is added to the substrate at level sufficient to provide the desired benefits of the present invention. A convenient method of combining the composition of the present invention with the chosen substrate is to place the substrate inside an open package that will ultimately house the finished product until use. The composition is poured onto the substrate and allowed to distribute throughout. It is preferred that the homogenous composition is poured onto each wipe individually rather than onto a stack of wipes. The package is then closed and the wipes ready for use. An alternative method is for the composition to be applied to the substrate while the substrate is a continuous web. The application could be in many forms, including one or more of, but not limited to coating, immersing, dipping, spraying, extruding and the like. Once the composition is applied the substrate is cut to the desired length and then packaged for sale. This could include folding the wipe and/or interfolding with other wipes, prior to final packaging.

The compositions may be added to the substrate to form the premoistened wipe in any convenient fashion. For example, the components could all be mixed together and then sprayed onto the substrate; each component could be deposited on the substrate separately; or half the ingredients could be mixed together and then added to the substrate, with the remainder then being mixed together and then sprayed on to the substrate.

(D) Usage

The premoistened wipes and processes described herein can provide effective disinfectancy/sanitization. In order to provide good kill of microorganisms, especially bacteria, one should use high concentrations and/or longer exposure times. Typically, the premoistened wipes should be used full strength and allowed to remain on the food, toy, infant contact surfaces, and/or food contact surfaces for up to about one half minute, preferably up to about one minute. Longer exposure times (i.e., the time that the bacteria are in contact with the product) are not required to observe antimicrobial benefits. The importance of time depends both on the pH of the product and on the formula concentration. At high pH ($\geqq 11.5$) and high concentrations, or low pH ($\leqq 3.0$) and high concentrations antibacterial efficacy is achieved quickly. At lower pH values ($pH \leqq 11$) and lower formula concentrations, or higher pH values ($pH \geqq 3.5$) and lower formula concentrations longer period of exposure time, say about 1 to 3 minutes, is required to achieve the same efficacy.

Higher pHs are also better, in general. This factor is important for the product's performance on the Gram negative bacteria, e.g., *Escherichia coli* and Pseudomonas species. Higher product pH's produce quicker and more complete kill.

As stated above, higher formula concentrations (when done independently of pH) enhance the antimicrobial efficacy of the product. While not wanting to be limited by theory, the presence of sodium lauryl sulfate is believed to be a key factor for the performance on Gram-positive organisms like *S. aureus*, while the pH is probably a bigger factor for the Gram-negative bacteria, e.g., *E. coli* and Pseudomonas species.

Packaging the products herein in a container with instructions for usage in terms of timing and proper dilution in order to provide disinfectancy/sanitization, will help the individual consumer by providing information for proper usage in order to remove/kill microorganisms. It is a special advantage of the product that it can be used for this purpose at a time in the food production process where recontamination is minimized. The instructions desirably provide assurance that short times are acceptable and/or that rinsing is not needed in order to avoid possible recontamination by rinsing with impure water.

Food

All kinds of foods can be treated. Examples include: produce including fruits and vegetables such as apples, grapes, peaches, potatoes, lettuce, tomatoes, celery, and the like, that are to be eaten after treatment, and edible animal protein, especially meat, seafood and poultry, including foodstuffs which are comprised essentially of the protein found in such foods sources including, but not limited to, beef, pork, chicken, turkey, fish, shellfish and game meats such as venison, rabbit and the like. Said edible animal protein includes the processed forms of said protein sources, including, but not limited to, such forms as ground beef, ground turkey, bologna, hot dogs, sausages, fish cakes, and the like. The food is preferably ready to eat after treatment, and is eaten shortly thereafter to minimize recontamination.

Food Contact Surfaces

The compositions can also be used for cleaning (especially spot removal), disinfectancy, or sanitization, on non-food (i.e., any surface which is not used as food, even those which are not in contact with food), inanimate, household surfaces, especially those used in food production and other food-contacting surfaces (surfaces that come in contact with food). Such surfaces include, for example, cutting boards, counter tops, utensils, dishes, colanders, sinks, sponges, towels, dishcloths, cloth napkins (serviettes), tablecloths, and other surfaces that come in contact with food. It is desirable to clean and/or disinfect/sanitize before the surfaces come in contact with the food, and is desirable to redisinfect/sanitize whenever the surfaces become recontaminated. The products herein, containing all GRAS and/or food grade ingredients, are preferred for this purpose. On hard surfaces, of course, the compositions can be removed, after sufficient time has elapsed, by rinsing if pure water is available, or by absorption/wiping with an appropriate object, e.g., paper towel, sponge, squeegee, etc.

Toys and/or Infant Contact Surfaces

The compositions of this invention can also be used to treat/clean other non-food inanimate household surfaces, such as fabrics, e.g., clothing, shoes, and shower curtains, especially those that are used by infants, especially toys, diapers (napkins), and bibs. The contaminated fabrics can be disinfected/sanitized, then allowed to drain and/or dry, while minimizing the risk if the infant puts the fabric or other article in its mouth. However, it is desirable to rinse fabrics, at least with water that is only slightly alkaline. The fabric can be treated totally, or by spot treatment, then the composition is preferably removed, at least partially, e.g., by draining, absorbency, and/or mechanical force. The products can also be used to treat animals and humans to clean and/or disinfect skin, hair, etc. Care should be used to avoid damage if the product has a high pH. It is also within the scope of the present invention that the premoistened wipes may be formulated to such that they are suitable for direct application to an infant as well as a surface. For example, a premoistened wipe could be used to clean up a food spill created by a toddler after the wipe was used to clean the child's hands and mouth. For example, a child drops a pacifier in a store. The child's mother wipes the pacifier with a premoistened wipe, as described herein, prior to returning it to the child. The premoistened wipe cleans the pacifier removing any germs, microbial organisms, dirt grease, particulate matter, lint, fluff etc. from the dropped pacifier.

The wipe may also be used on the skin of a caregiver. For example, if the care giver had been handling uncooked meant, they could remove any meat juices from their hand and skin by cleaning themselves with a premoistened wipe according to the present invention, before they play or interact with the child. This would prevent dirt, germs and such from reaching the child by transmission through a third party.

For fabrics, the pH of the compositions is preferably below about 11.5, more preferably below 11.0.

Sale of Food, Toys and/or Infant Contact Surfaces

The present invention also encompasses a method of promoting the sale of food items, toys and infant contact surfaces, including produce such as fruits and vegetables, as well as second hand toys, which generally comprises contacting the items (as described hereinbefore) with the premoistened wipe comprising a substrate and a cleaning composition, both of which are hereinbefore described, and providing informational indicia, such as an advertisement, logo, brochure, sticker, sign, or other printed matter, electronic information, in association with said items to indicate/communicate to a consumer of the items that the items have been treated with the premoistened wipe. Providing the informational indicia is an important element of the present method since communicating such information to a consumer allows the consumer to have confidence that the items, especially produce such as fruits and vegetables, and second hand toys, are clean and have reduced levels of pesticides, waxes, bacteria, and the like. Indeed, consumers who otherwise would not consume or purchase food items that have not been treated with a composition to clean and reduce microorganisms on the food items, would be influenced to consumer or purchase the food items when the fact that the items have been treated is communicated to the consumer.

EXAMPLES

Example 1

Examples A–E show formulations of the present invention which may be combined with a 100% polyester spun lace nonwoven wipe, available from Green Bay Nonwoven, to prepare a premoistened wipe in accordance with the present invention.

| Material | A % by wt | B % by wt | C % by wt | D % by wt | E % by wt |
|---|---|---|---|---|---|
| Oleic acid | | 0.6 | | | |
| Ethyl Alcohol | 10.0 | 7.0 | 5.4 | 5.0 | 5.0 |
| KOH | 0.34 | 1.1 | 0.4 | | |
| NaOH | | 0.2 | | 0.15 | 0.15 |
| Sodium bicarbonate | 0.20 | 0.2 | | | |
| Citric acid | 0.10 | 0.5 | | | |
| Sodium Lauryl Sulfate | | 1.0 | 0.05 | 0.20 | 0.06 |
| Polysorbate 60 | | | 0.04 | | |
| Grapefruit Oil | 0.03 | 0.01 | | | |
| Limonene | | 0.2 | 1.0 | | |
| Lime #63 | | | | 1.00 | 1.00 |
| Water | q.s. to 100 | q.s. to 100 | q.s. to 100 | q.s. to 100 | q.s. to 100 |

Example 2

Examples A–E show formulations of the present invention which may be combined with a 70/30 polypropylene/Rayon carded nonwoven wipe, available from PGI to prepare a premoistened wipe in accordance with the present invention.

| Material | A % by wt | B % by wt | C % by wt | D % by wt | E % by wt |
|---|---|---|---|---|---|
| Oleic acid | | 0.6 | | | |
| Ethyl Alcohol | 10.0 | 7.0 | 5.4 | 5.0 | 5.0 |
| KOH | 0.34 | 1.1 | 0.4 | | |
| NaOH | | 0.2 | | 0.15 | 0.15 |
| Sodium bicarbonate | 0.20 | 0.2 | | | |
| Citric acid | 0.10 | 0.5 | | | |
| Sodium Lauryl Sulfate | | 1.0 | 0.05 | 0.20 | 0.06 |
| Polysorbate 60 | | | 0.04 | | |
| Grapefruit Oil | 0.03 | 0.01 | | | |
| Limonene | | 0.2 | 1.0 | | |
| Lime #63 | | | | 1.00 | 1.00 |
| Water | q.s. to 100 | q.s. to 100 | q.s. to 100 | q.s. to 100 | q.s. to 100 |

Example 3

Preparation of a premoistened wipe according to the present invention:

(a) Preparation of the composition

The following ingredients are mixed together and stirred until all products dissolve and the composition has an even consistency:

| Composition | % by wt |
|---|---|
| Sodium Lauryl Sulfate | 0.20 |
| Oleic acid | 0.05 |
| Citric acid | 0.54 |
| Sodium Bicarbonate | 2.00 |
| Sodium hydroxide | 1.30 |
| Ethanol | 4.50 |
| Grapefruit Oil | 0.05 |
| Disodium EDTA dihydrate | 0.003 |
| Water | q.s to 100% |
| pH | 11.5 |

The composition (a) in example 3 can show a 5-log reduction in Gram-positive and Gram-negative bacteria as well as being effective against some viruses, such as, rota virus. Bacterial and viral reduction would be present in any premoistened wipe containing the composition.

(b) Preparation of the Substrate

The substrate, a 100% polyester spun lace nonwoven wipe, available from Green Bay Nonwoven, is obtained as rolled continuous web. The web roll is slit to achieve the desired finished premoistened wipe width. The resultant silted webs are then impregnated with the composition prepared in (a) by passing the individual webs under sprayers thru which the composition of (a) is applied to the web. The composition is sprayed at a rate sufficient to obtain a loading factor of at least about 2.5 grams of composition per gram of dry substrate.

Following impregnation, the substrate is then cut to the desired premoistened wipe length.

Example 4

A premoistened wipe according to Example 3 is prepared except that the substrate (b) is a 70/30 polypropylene/Rayon carded nonwoven wipe, available from PGI

Example 5

A premoistened wipe according to Example 3 is prepared except that the composition (a) has the formula:

| Composition | % by wt |
|---|---|
| Glycerol | 2.0 |
| Oleic acid | 2.64 |
| Citric acid | 0.52 |
| Sodium Bicarbonate | 0.55 |
| Potassium hydroxide | 1.33 |
| Ethanol | 2.0 |
| Grapefruit Oil | 0.035 |
| EDTA | 0.003 |
| Water | q.s to 100% |
| pH | 11.5 |

The composition in example 5 can show a 5-log reduction in Gram-negative bacteria. Bacterial reduction would be present in any premoistened wipe containing the composition.

Example 6

A premoistened wipe according to Example 5 is prepared except that the substrate (b) is a 70/30 polypropylene/Rayon carded nonwoven wipe, available from PGI Example 7

A premoistened wipe according to Example 3 is prepared except that the composition (a) has the formula:

| Composition | % by wt |
|---|---|
| Sodium Lauryl Sulfate | 0.06 |
| Oleic acid | 0.03 |
| Sodium hydroxide | 0.15 |
| Ethanol | 5.0 |
| Perfume (Waterlily) | 0.03 |
| Disodium EDTA dihydrate | 0.003 |
| Water | q.s to 100% |
| pH | 12.5 |

Example 8

A premoistened wipe according to Example 7 is prepared except that the substrate (b) is a 70/30 polypropylene/Rayon carded nonwoven wipe, available from PGI Example 9

A child drops a pacifier in a store. The child's caregiver wipes the pacifier with a premoistened wipe of Example 6 prior to returning it to the child. The premoistened wipe cleans the pacifier as well as removing any germs, microbial organisms, dirt, grease, particulate matter, lint, and fluff from the dropped pacifier.

Example 10

A caregiver is preparing a meal involving chicken and beef The caregiver comes into contact with uncooked meat juices. Prior to feeding their infant, the caregiver wipes their hands and forearms with a premoistened wipe of Example 7. The premoistened wipe cleans the caregiver's hands and forearms as well as removing any germs, microbial organisms, or grease, which could have been subsequently transferred to the infant. After feeding the infant, the caregiver wipes the infant's hands, forearms, and face with a premoistened wipe of Example 7. The caregiver then uses the wipe to clean any surface which has spilt food that the infant may later contact.

What is claimed is:

1. A premoistened wipe comprising:

(a) a nonwoven substrate, said substrate being selected from the group consisting of carded nonwovens, airlaid nonwovens, melt blown nonwovens and spunbonded nonwovens; and (b) a composition comprising:

(i) optionally, a toxicologically-acceptable anionic surfactant;

(ii) optionally, a toxicologically-acceptable chelant;

(iii) optionally, a toxicologically-acceptable nonionic surfactant;

(iv) optionally, a toxicologically-acceptable buffer;

(v) optionally, a toxicologically-acceptable preservative;

(vi) optionally, a toxicologically-acceptable suds suppressor;

(vii) optionally, a toxicologically-acceptable perfume; and (viii) the balance comprising an aqueous carrier, said aqueous carrier comprising water and optionally, a low molecular weight, toxicologically-acceptable organic solvent;

wherein said composition contains at least a surfactant selected from the group consisting of (i), (iii) and combinations thereof; said composition has a pH of from about 9.5 to about 13.0 and is loaded onto said substrate at a loading factor of at least about 0.5 grams of composition per gram of dry substrate so that said substrate is wet by said composition; wherein said substrate is releasably carries the composition; and said composition comprises only GRAS and/or food grade ingredients.

2. The premoistened wipe of claim 1, wherein said anionic surfactant is selected from the group consisting of alkali or alkaline earth salts of $C_{6-16}$ alkyl sulfate, alkali or alkaline earth salts of $C_{6-16}$ alkyl sulfonate, $C_{8-18}$ fatty acid and salts thereof and mixtures thereof.

3. The premoistened wipe of claim 2, wherein said anionic surfactant is selected from the group consisting of sodium or potassium salts of $C_{6-16}$ alkyl sulfates, $C_{8-18}$ fatty acid or salts thereof, sodium or potassium salts of $C_{6-16}$ alkyl sulfonates, and mixtures thereof.

4. The premoistened wipe of claim 1, wherein said composition contains at least two of (i) to (vii).

5. The premoistened wipe of claim 1, wherein said buffer is selected from the group consisting of water soluble borates, hydroxides, ortho-phosphates, carbonates, bicarbonates, citrates and mixtures thereof.

6. The premoistened wipe of claim 1, wherein said chelant is selected from the group consisting of sodium polyphosphate, potassium polyphosphate, organic polycarboxylate and mixtures thereof.

7. The premoistened wipe of claim 6, wherein said chelant is selected from the group consisting of sodium polyphosphate, potassium polyphosphate, ethylenediaminetetraacetate, citrate, and mixtures thereof.

8. The premoistened wipe of claim 1, wherein said organic solvent is selected from the group consisting of $C_2$–$C_6$ alcohols, $C_2$–$C_6$ diols, $C_2$–$C_6$ triols, and mixtures thereof.

9. The premoistened wipe of claim 8, wherein said organic solvent is selected from the group consisting of ethanol, glycerol, and mixtures thereof.

10. The premoistened wipe of claim 1, wherein said composition comprises:

(i) from about 0.01% to about 5.0% by weight of composition of said anionic surfactant;

(ii) from about 0.0005% to about 3.0% by weight of composition of said chelant;

(v) from about 0.0005% to about 10.0% by weight of composition of said buffer;

(vii) from about 0.01% to about 1.0% by weight of composition of perfume; and (viii) the balance comprising said aqueous carrier, said aqueous carrier comprising water and said low molecular weight, toxicologically-acceptable organic solvent.

11. An article of commerce according to claim 1, wherein said article is further provided with informational indicia, wherein said informational indicia is selected from the group consisting of an advertisement, logo, brochure, sticker, sign, and combinations thereof.

12. An article according to claim 11, wherein said informational indicia are a sign comprising a brand name of said premoistened wipes.

13. A method of treating a toy comprising contacting said toy with the premoistened wipe of claim 1.

14. A method of cleaning food comprising contacting said food with the premoistened wipe of claim 1.

15. The premoistened wipe according to claim 1 wherein said composition has a pH of from about 10.0 to about 13.0.

16. An article of commerce comprising:

(1) container, said container housing;

(2) one or more premoistened wipes comprising:

(a) a nonwoven substrate, said substrate being selected from the group consisting of carded nonwovens, air-laid nonwovens, melt blown nonwovens and spunbonded nonwovens; and (b) a cleaning composition comprising:

(i) optionally, a toxicologically-acceptable anionic surfactant;

(ii) optionally, a toxicologically-acceptable chelant;

(iii) optionally, a toxicologically-acceptable non-ionic surfactant;

(iv) optionally, a toxicologically-acceptable buffer;

(v) optionally, a toxicologically-acceptable preservative;

(vi) optionally, a toxicologically-acceptable suds suppressor;

(vii) optionally, a toxicologically-acceptable perfume; and (viii) the balance comprising an aqueous carrier, said aqueous carrier comprising water and optionally, a low molecular weight, toxicologically-acceptable organic solvent;

wherein said composition contains at least a surfactant selected from the group consisting of (i), (iii) and combinations thereof; said composition has a pH of from about 9.5 to about 13.0 and is loaded onto said substrate at a loading factor of at least about 0.5 grams of composition per gram of dry substrate so that said substrate is wet by said composition; wherein said substrate releasably carries the composition; and said composition comprises only GRAS and/or food grade ingredients; and (3) set of instructions comprising an instruction to wipe a surface with said premoistened wipe, wherein said surface is selected from the group consisting of food, toys, food contact surfaces and infant contact surfaces.

17. The article of commerce according to claim 16, wherein said anionic surfactant is selected from the group consisting of alkali or alkaline earth salts of $C_{6-16}$ alkyl sulfate, alkali or alkaline earth salts of $C_{6-16}$ alkyl sulfonate, $C_{8-18}$ fatty acid and salts thereof and mixtures thereof.

18. The article of commerce according to claim 16, wherein said anionic surfactant is selected from the group consisting of sodium or potassium salts of $C_{6-16}$ alkyl sulfates, $C_{8-18}$ fatty acid or salts thereof, sodium or potassium salts of $C_{6-16}$ alkyl sulfonates, and mixtures thereof.

19. The article of commerce according to claim 16, wherein said composition contains at least two of (i) to (vii).

20. The article of commerce according to claim 16, wherein said buffer is selected from the group consisting of water soluble borates, hydroxides, ortho-phosphates, carbonates, bicarbonates, citrates and mixtures thereof.

21. The article of commerce according to claim 16, wherein said chelant is selected from the group consisting of sodium polyphosphate, potassium polyphosphate, organic polycarboxylate and mixtures thereof.

22. The article of commerce according to claim 21, wherein said chelant is selected from the group consisting of sodium polyphosphate, potassium polyphosphate, ethylenediaminetetraacetate, citrate, and mixtures thereof.

23. The article of commerce of claim 16, wherein said organic solvent is selected from the group consisting of $C_2$–$C_6$ alcohols, $C_2$–$C_6$ diols, $C_3$–$C_6$ triols, and mixtures thereof.

24. The article of commerce according to claim 23, wherein said organic solvent is selected from the group consisting of ethanol, glycerol, and mixtures thereof.

25. The article of commerce according to claim 16, wherein said composition comprises:

(i) from about 0.01% to about 5.0% by weight of composition of said anionic surfactant (iii) from about 0.0005% to about 3.0% by weight of composition of said chelant;

(v) from about 0.0005% to about 10.0% by weight of composition of said buffer;

(vii) from about 0.01% to about 1.0% by weight of composition of said perfume; and (viii) the balance comprising said aqueous carrier, said aqueous carrier comprising water and said low molecular weight, toxicologically-acceptable organic solvent.

* * * * *